US010959538B2

(12) United States Patent
Williams

(10) Patent No.: US 10,959,538 B2
(45) Date of Patent: Mar. 30, 2021

(54) INFANT HOLDER

(71) Applicant: Janet Y. Williams, Stamford, CT (US)

(72) Inventor: Janet Y. Williams, Stamford, CT (US)

( * ) Notice: Subject to any disclaimer, the term of this patent is extended or adjusted under 35 U.S.C. 154(b) by 0 days.

(21) Appl. No.: 16/206,028

(22) Filed: Nov. 30, 2018

(65) Prior Publication Data

US 2019/0167010 A1 Jun. 6, 2019

Related U.S. Application Data

(60) Provisional application No. 62/593,915, filed on Dec. 2, 2017.

(51) Int. Cl.
*A47D 13/02* (2006.01)
*A47D 15/00* (2006.01)

(52) U.S. Cl.
CPC ..... *A47D 13/02* (2013.01); *A47D 15/008* (2013.01)

(58) Field of Classification Search
CPC ..... A47D 13/02
See application file for complete search history.

(56) References Cited

U.S. PATENT DOCUMENTS

| | | | | | |
|---|---|---|---|---|---|
| 5,551,109 | A * | 9/1996 | Tingley | A47D 13/02 | 128/870 |
| D593,787 | S * | 6/2009 | Dafna | D6/601 | |
| D612,187 | S * | 3/2010 | Visco | D6/604 | |
| 7,676,871 | B1 * | 3/2010 | Leach | A47D 13/08 | 5/653 |
| 8,555,429 | B2 * | 10/2013 | Leach | A47K 3/127 | 4/572.1 |
| 9,332,791 | B1 * | 5/2016 | Bush | A41D 11/00 | |
| 9,554,659 | B2 * | 1/2017 | Doering | A47D 9/00 | |
| 9,788,663 | B2 * | 10/2017 | Furuland | A47D 7/01 | |
| 2004/0149600 | A1 * | 8/2004 | Wolter | A45C 13/02 | 206/223 |
| 2007/0245494 | A1 * | 10/2007 | Dockendorf | A47C 16/00 | 5/655 |
| 2010/0187268 | A1 * | 7/2010 | Rosen | A47D 13/02 | 224/158 |
| 2015/0265015 | A1 * | 9/2015 | Lee | A45C 7/0077 | 190/107 |
| 2016/0219942 | A1 * | 8/2016 | McCampbell | A41B 13/06 | |
| 2017/0318865 | A1 * | 11/2017 | Karnati | A47D 13/02 | |

* cited by examiner

*Primary Examiner* — Corey N Skurdal
(74) *Attorney, Agent, or Firm* — Whitmyer IP Group LLC

(57) ABSTRACT

Disclosed herein is an infant holder to safely secure, hold, and properly support a relatively small or premature infant during a feeding session using a substantially circular or oval base, releasably fastening straps to secure the infant, adjustable bolsters to support the infant, and straps or a pass-through tube to secure the holder to a caregiver's arm or hand.

20 Claims, 9 Drawing Sheets

INFANT HOLDER

TECHNICAL FIELD

The present teachings relate generally to the ability to safely secure, hold, and properly support a relatively small or premature infant during a feeding session.

BACKGROUND

There are no known devices in the market place to easily and securely hold a relatively small or premature infant during a feeding session. Current devices present a struggle for the caregiver and can cause harm to the infant through misuse or unsuitable design. As such, caregivers must improvise techniques in an attempt to securely and safely hold a small infant during feeding which can be detrimental to the infant's health and wellbeing depending on the skill of the caregiver. Other techniques involve placing the infant in a crib or other apparatus that separates the infant from the caregiver. Because holding the infant is essential to their development, a device has been developed for holding the infant in a safe and secure manner while the infant is fed.

SUMMARY

The needs set forth herein as well as further and other needs and advantages are addressed by the present embodiments, which illustrate solutions and advantages described below.

The present teachings address a number of problems in the prior art by providing a means to hold a relatively small or premature infant in a safe and secure manner while the infant is fed. In one example, an apparatus is provided to securely hold a relatively small or premature infant. The apparatus has a base to support the infant, a plurality of adjustable straps that secure the infant, an adjustable bolster for supporting the infant, spaces in the bolster for the infant's legs to rest, and a pass through tube for the caregiver's arm or hand. The plurality of adjustable straps can have a multitude of fasteners, including, hook and loop, hook and pile, touch type, snap type, locking D-ring type, and belt type (roller, holes, and pin) fasteners. The bolsters can provide support by containing poly fill, foam, memory foam, feathers, air bladders, gel-type bladders, or any combination of these materials. The apparatus, including the backside, base, and bolsters, can be covered in, but is not limited to, a fabric that is washable, and can be cotton, linen, polyester, or wool.

The device of the present embodiment includes, but is not limited to, an infant holder comprised of a base having first and second sides; a bolster positioned on the first side of the base forming a wall around an inner portion of the first side of the base thereby creating an oblong partial enclosure on the front side of the base in which an infant can be contained; a releasable fastener on the first side of the base for securing an infant to the first side of the base; and a fastener on the second side of the base to secure the infant holder to an object.

In one example, the infant holder bolster position is adjustable and thereby a size and a shape of the partial enclosure is variable by adjustment of the position of the bolsters.

In one example, the infant holder has a first end and second end directly opposing each other, the bolster at the first end having a gap in which the leg of an infant can rest.

In one example, the infant holder first side releasable fastener comprises a plurality of straps for securing an infant to the first side of the base.

In one example, the plurality of straps comprises a hook and loop fastener.

In one example, the plurality of straps comprises a hook and pile fastener.

In one example, the plurality of straps comprises a snap fastener.

In one example, the plurality of straps comprises a d-ring type fastener.

In one example, the plurality of straps comprises a touch type fastener.

In one example, the bolster comprises a plurality of bolsters.

In one example, the bolster comprises washable fabric.

In one example, the bolster comprises memory foam.

In one example, the bolster comprises air bladders.

In one example, the bolster comprises gel-type bladders.

In one example, the bolster comprises soft, compliant padding materials.

In one example, the second side fastener comprises a pass through tube, the pass through tube comprising pliable, elastic material.

In one example, the second side fastener comprises a plurality of straps.

In one example, the plurality of straps comprises a hook and loop fastener.

In one example, the plurality of straps comprises a hook and pile fastener.

In one example, the plurality of straps comprises a snap type fastener.

Other embodiments of the system and method are described in detail below and are also part of the present teachings.

For a better understanding of the present embodiments, together with other and further aspects thereof, reference is made to the accompanying drawings and detailed description, and its scope will be pointed out in the appended claims.

DETAILED DESCRIPTION

Figure 1:
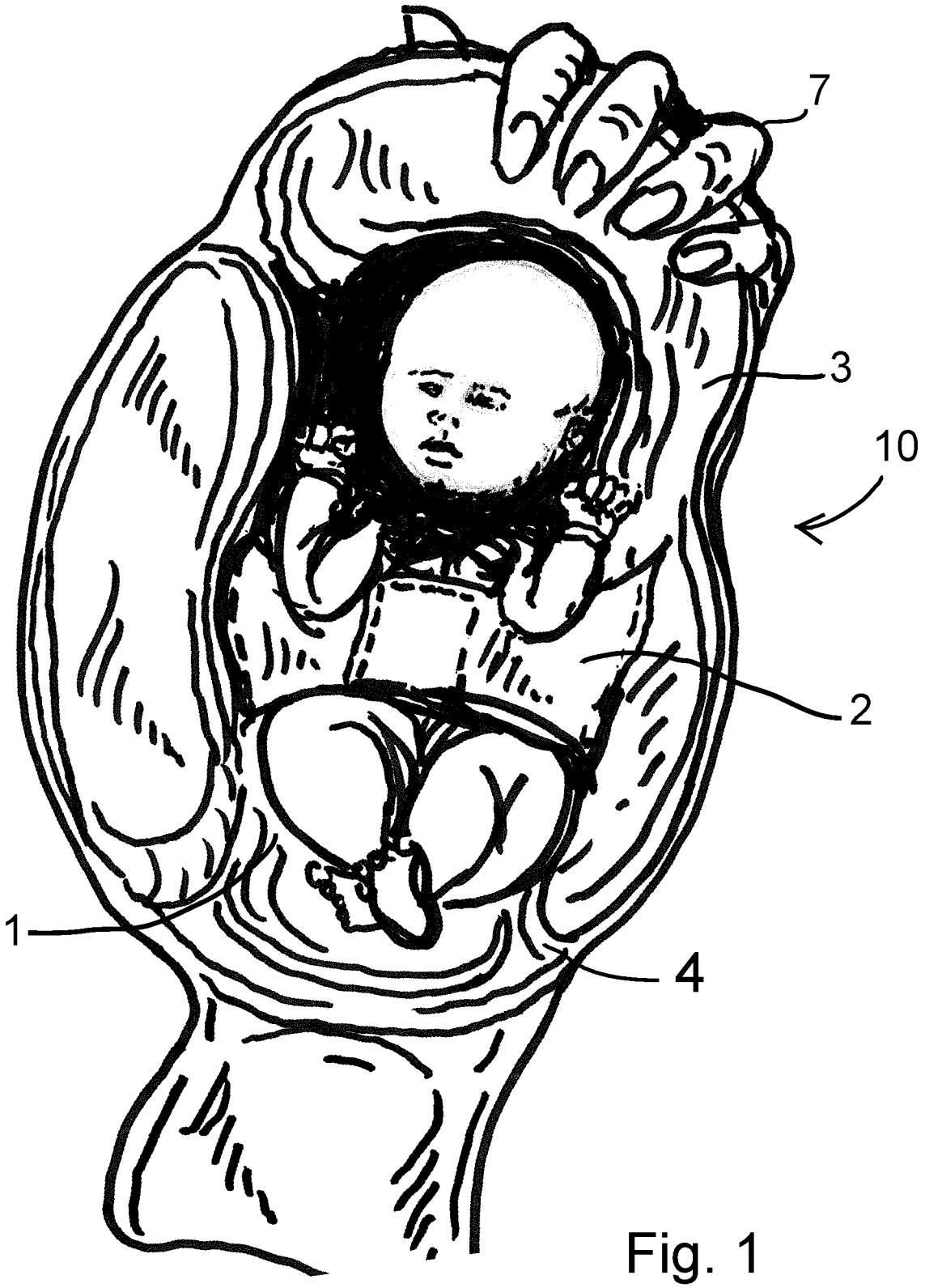
FIG. 1 is of one embodiment of the infant holder with an infant secured in the inner portion of the device by releasably fastened straps and surrounded by bolsters.
Figure 2:
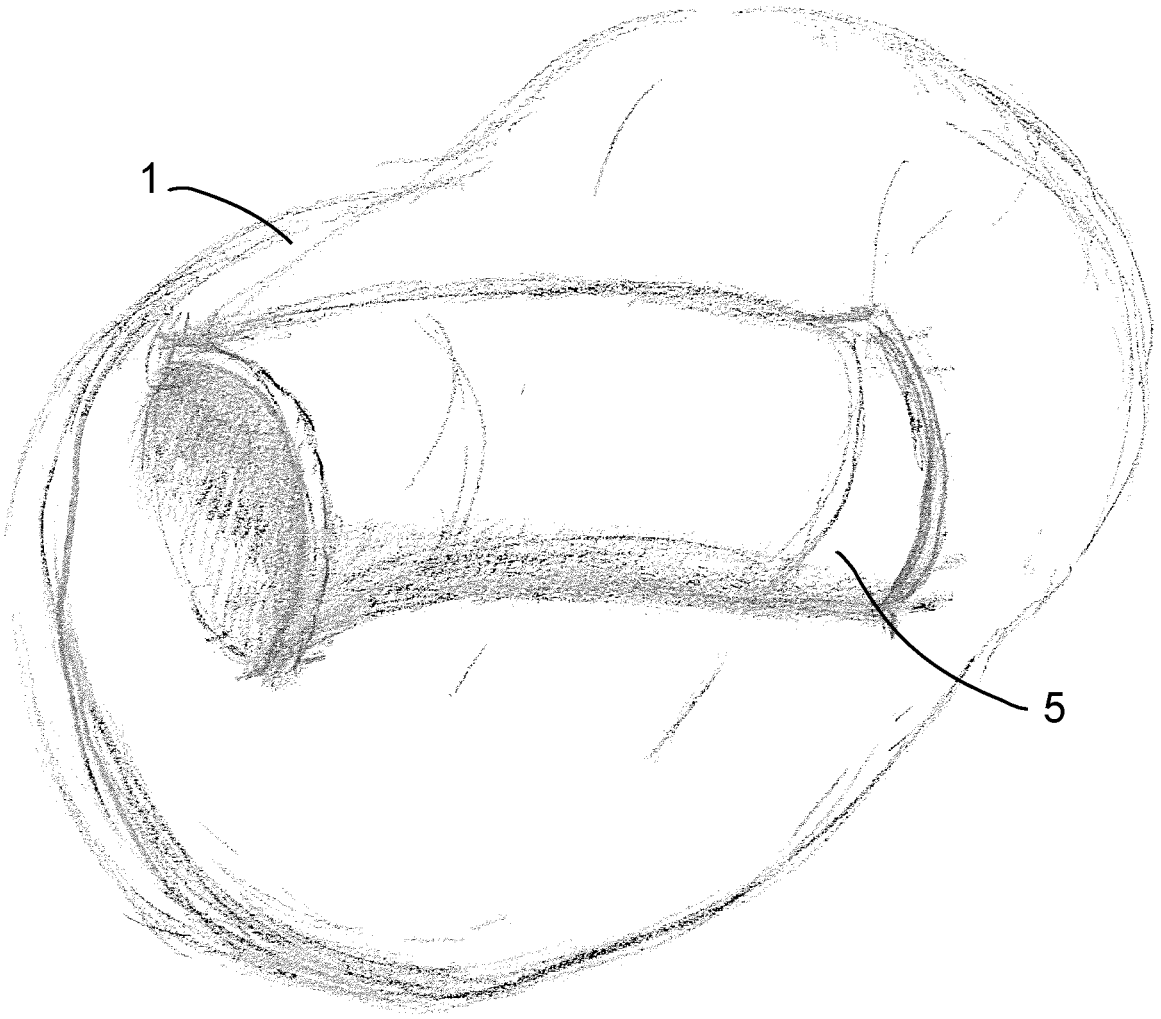
FIG. 2 is of one embodiment showing the backside of the infant holder showing a pass-through tube for a caregiver's hand or arm.

The present teachings are described more fully hereinafter with reference to the accompanying drawings, in which the present embodiments are shown. The following description is presented for illustrative purposes only and the present teachings should not be limited to these embodiments.

In compliance with the statute, the present teachings have been described in language more or less specific as to structural features. It is to be understood, however, that the present teachings are not limited to the specific features shown and described, since the systems and methods herein disclosed comprise preferred forms of putting the present teachings into effect.

For purposes of explanation and not limitation, specific details are set forth such as particular architectures, interfaces, techniques, etc. in order to provide a thorough understanding. In other instances, detailed descriptions of well-known devices, and methods are omitted so as not to obscure the description with unnecessary detail.

Generally, all terms used in the claims are to be interpreted according to their ordinary meaning in the technical field, unless explicitly defined otherwise herein. All references to a/an/the element, apparatus, component, means, step, etc. are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second," etc. for different features/components of the present disclosure are only intended to distinguish the features/components from other similar features/components and not to impart any order or hierarchy to the features/components.

As shown in FIGS. 1, 5, 6, and 7, an apparatus 10 is shown to securely hold an infant and/or a premature infant comprising a base 1 that supports the infant, a plurality of adjustable straps 2 that can secure an infant of different sizes, and a plurality of adjustable bolsters 3.

The base 1 can be generally circular or oval in shape and is covered with fabric that includes but not limited to soft washable fabric, cotton, linen, polyester, wool, or any other fabric known in the art and suitable for upholstery. Fluid or stain resistant materials may also be used.

When securing and infant, the plurality of adjustable straps 2 are fastened to each other by various methods, including but not limited to hook and loop type fasteners, hook and pile type fasteners, touch types fasteners, snap connectors with adjustable straps going through them, straps and locking D type rings, belt type (roller, holes and pin), snaps at a plurality of distances, and any other releasable fastener known in the art and suitable for releasably connecting straps. The plurality of adjustable straps 2 are fastened to the base 1 by various methods, including, but not limited to, sewing, fusing, bonding, gluing, riveting, or any other means known in the art for fastening straps to an object. In the case of an oval-shaped base 1, the plurality of adjustable straps 2 are oriented such that when the infant is secured, it is oriented longitudinally with the long direction of the oval-shaped base 1.

The plurality of adjustable bolsters 3 can comprise soft material support, including but not limited to, poly fill, foam, memory foam, feathers, adjustable air bladders, supportive gel type bladders, any combination of the above, or any soft, supportive material commonly known in the art and suitable for filling soft supportive bolsters. The plurality of adjustable bolsters 3 can comprise a removable or non-removable covering made out of various materials including, but not limited to, soft washable fabric, cotton, linen, polyester, wool, or any other fabric known in the art and suitable for upholstery. Liquid and stain resistant materials may also be used. The adjustable bolsters 3 can be moved so that their positions support infants of different shapes and sizes. Bolsters 3 can be positioned so that there is clearance 4 between bolsters 3 that allow for an infant's legs to go through comfortably.

The backside of apparatus 10 is shown in FIGS. 2, 3, 4, 8, and 9. Therein, the base 1 is covered with fabric that includes but not limited to soft washable fabric, cotton, linen, polyester, wool, or any other fabric known in the art and suitable for upholstery. Fluid or stain resistant materials may also be used. The fabric covering the base 1 has padding that can be but is not limited to foam, memory foam, poly fill, feathers, or any similar soft compliant materials known in the art. The backside of the device also has a pass through tube 5 for a caregiver's arm or hand 7 that is pliable in nature. The pass through tube 5 can be made out of, but is not limited to, elastic material, stretch type material, or any type of material known in the art to be compliant for to accommodate different sizes of caregiver arm or hand 7.

Figure 3:
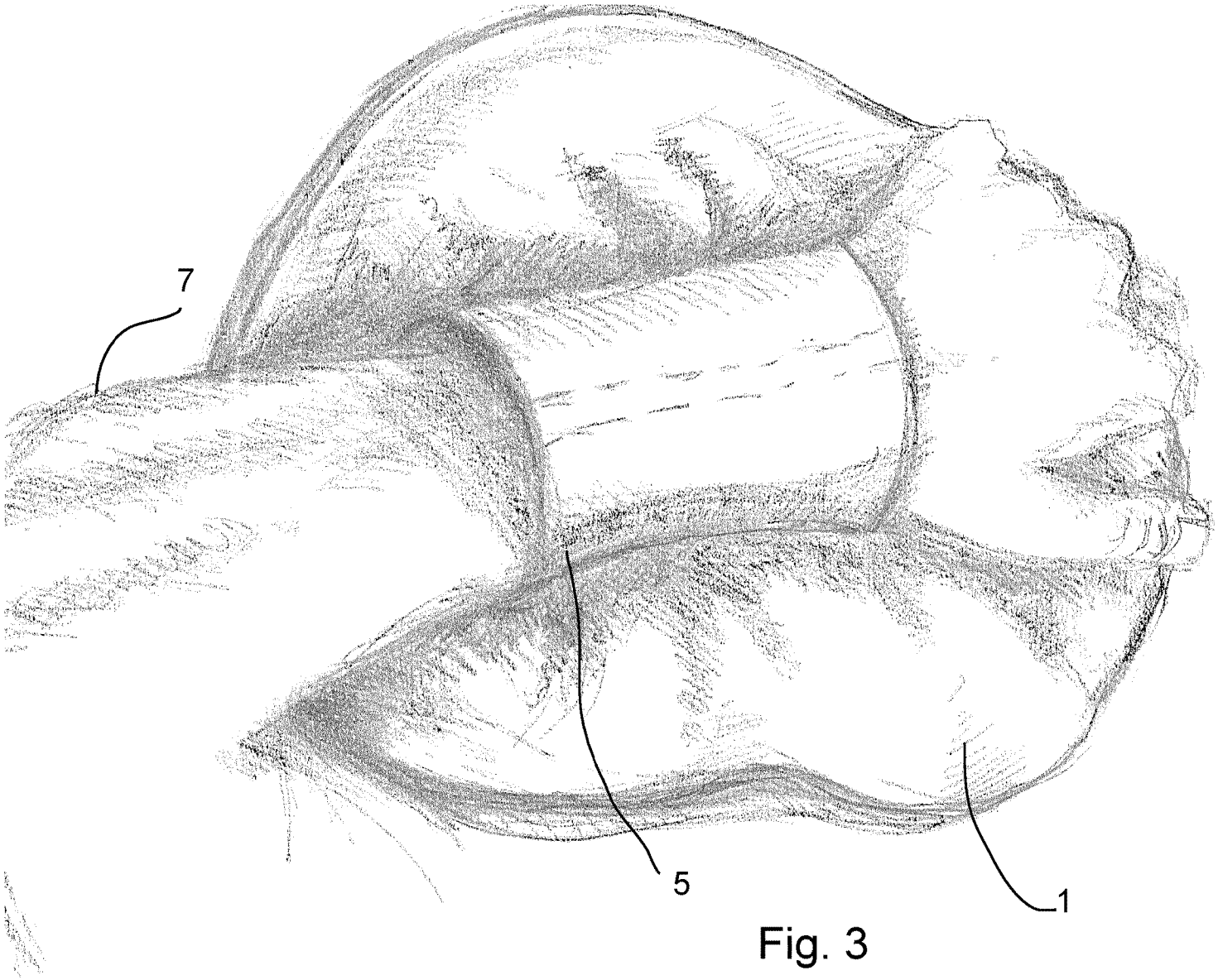
FIG. 3 is of one embodiment showing the backside of the infant holder showing a caregiver's arm in the pass-through tube.
Figure 4:
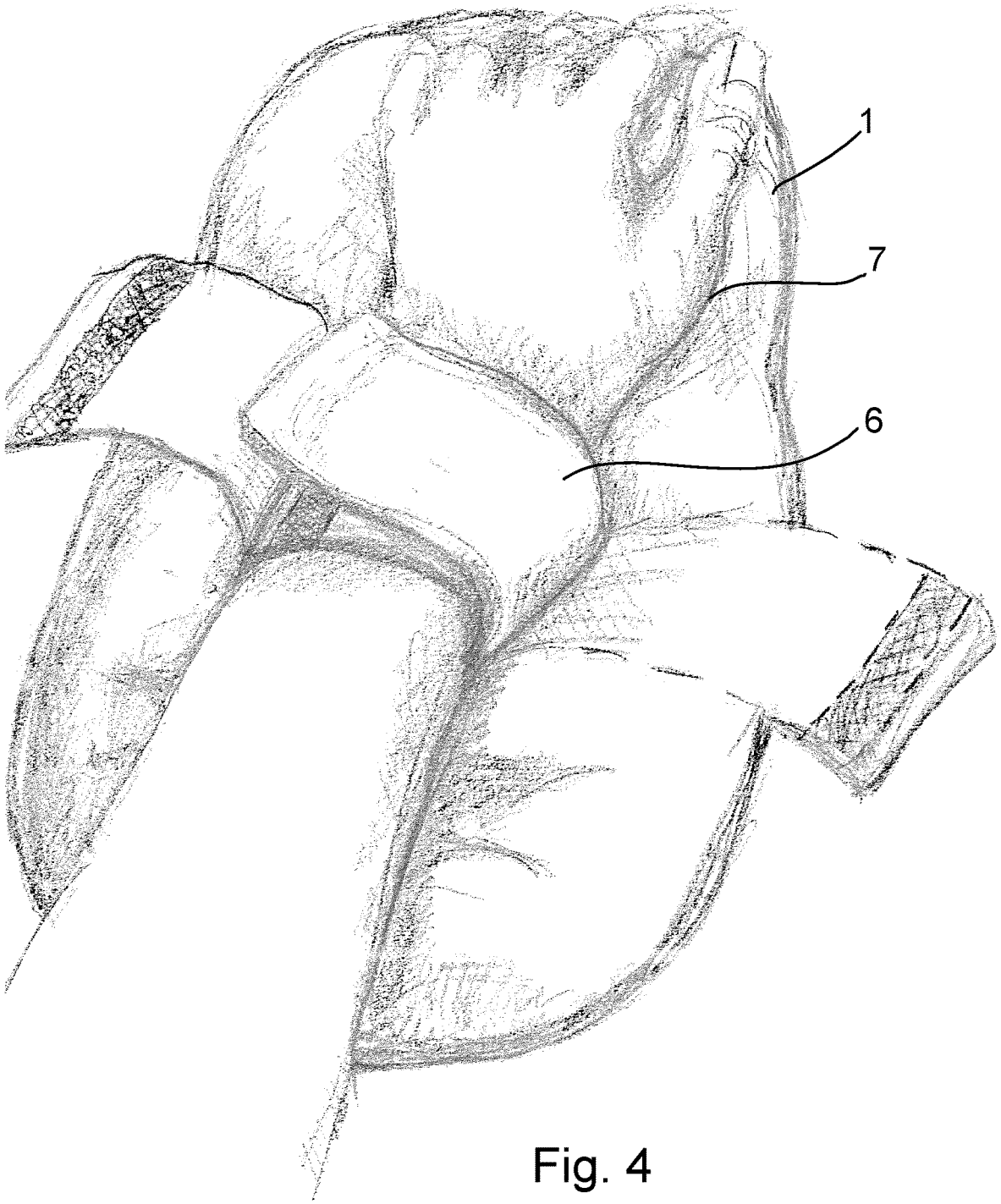
FIG. 4 is of one embodiment showing the backside of the infant holder showing the infant holder secured to a caregiver's arm by use of releasably fastened straps.
Figure 5:
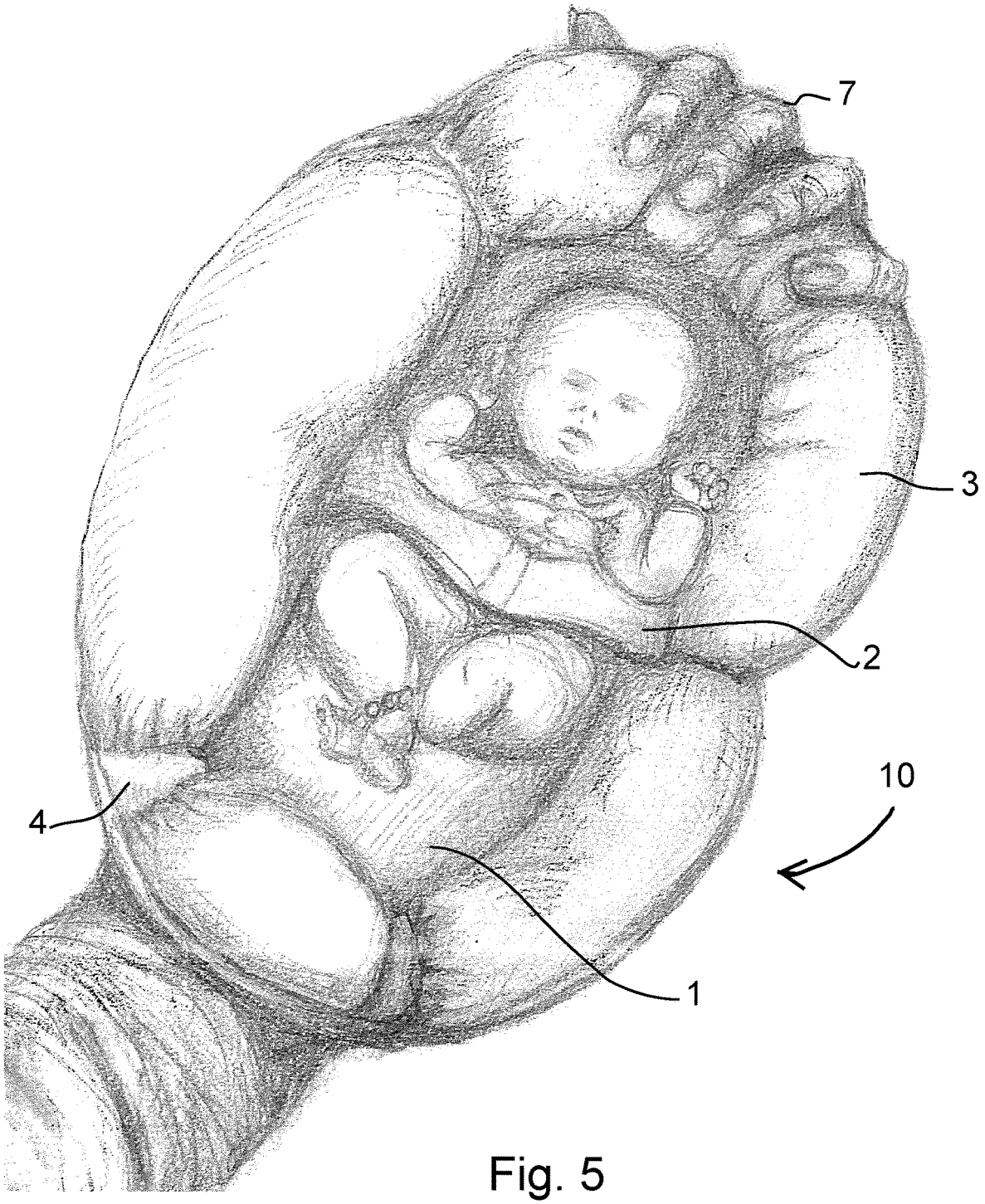
FIG. 5 is of one embodiment of the infant holder with and infant secured in the inner portion of the front side of the infant holder with releasably fastened straps and further surrounded by bolsters. The caregiver's hand and arm are shown in this representation of an average use of the device.
Figure 6:
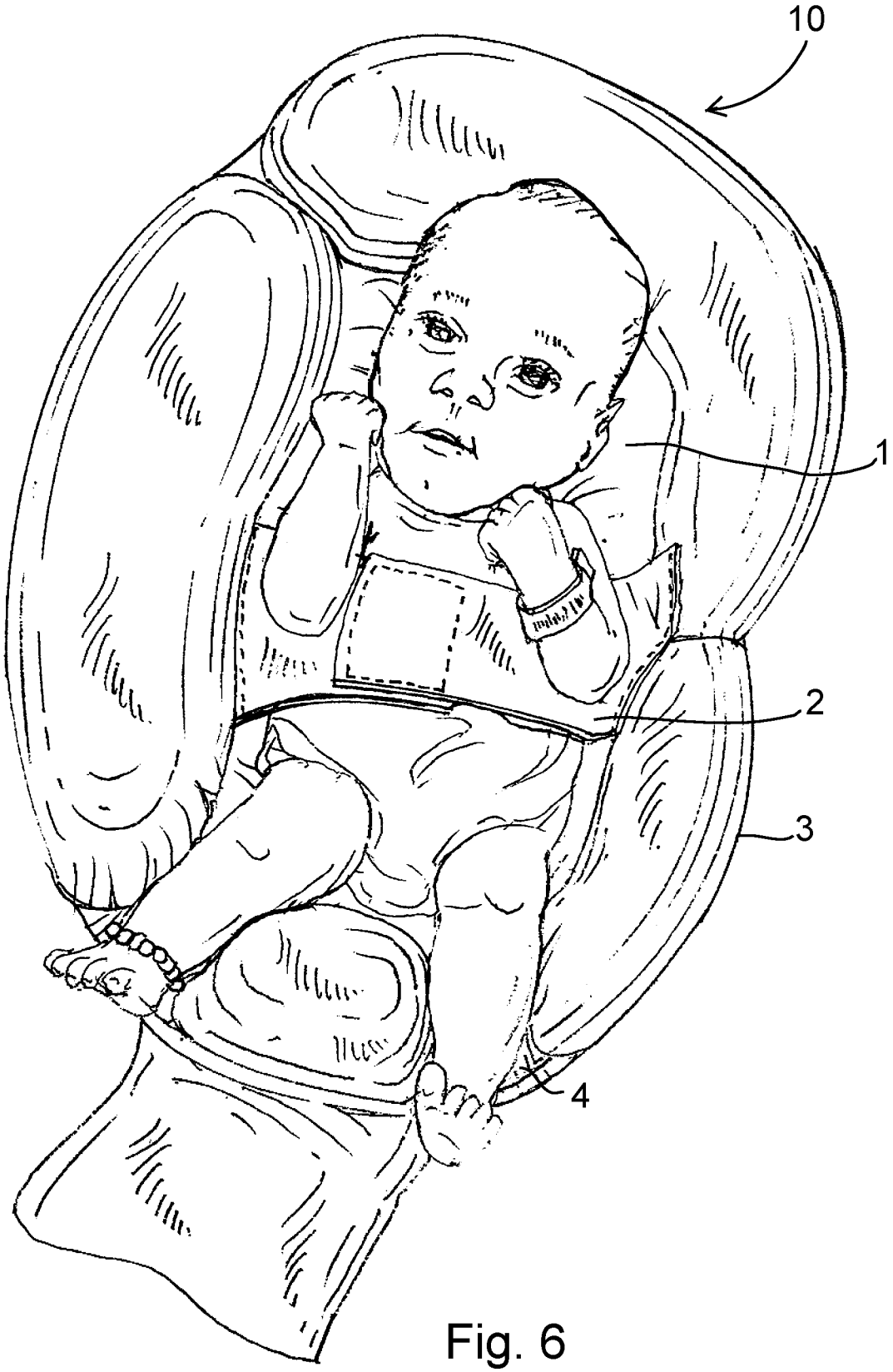
FIG. 6 is of one embodiment of the infant holder with an infant secured in the inner portion of the device by releasably fastened straps and surrounded by bolsters.
Figure 7:
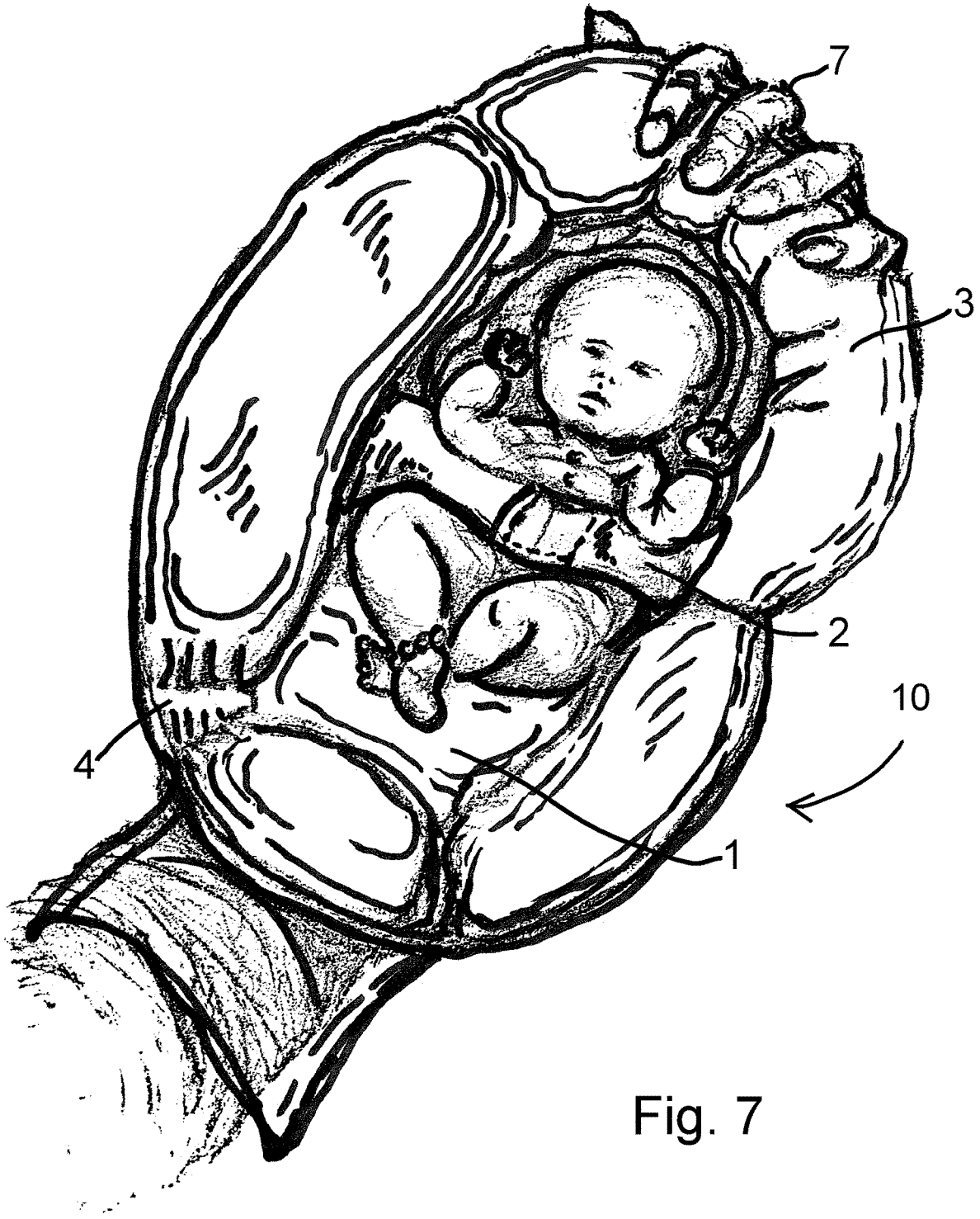
FIG. 7 is of one embodiment of the infant holder with and infant secured in the inner portion of the front side of the infant holder with releasably fastened straps and further surrounded by bolsters. The caregiver's hand and arm are shown in this representation of an average use of the device.
Figure 8:
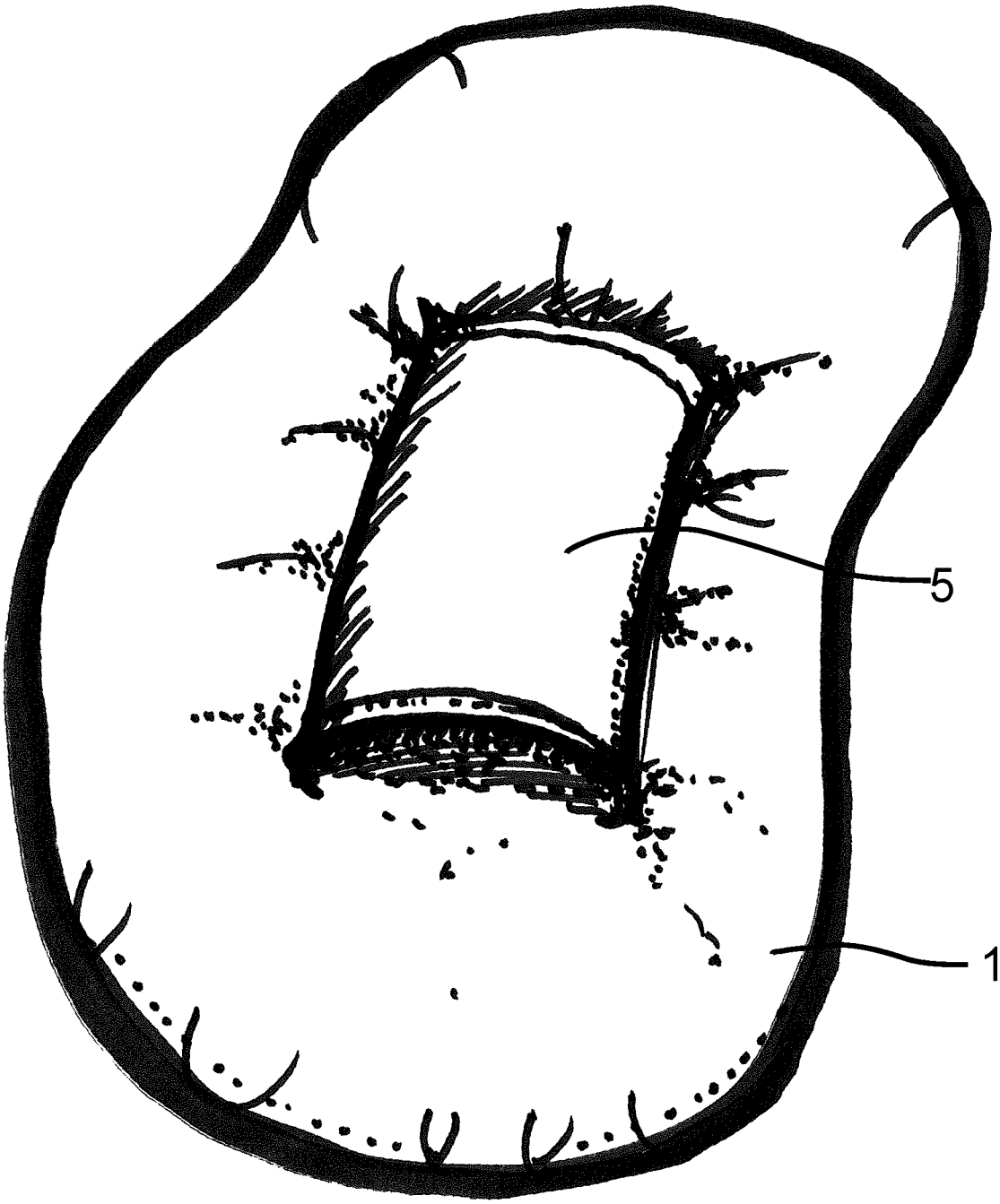
FIG. 8 is of one embodiment showing the backside of the infant holder showing a pass-through tube for a caregiver's hand or arm.
Figure 9:
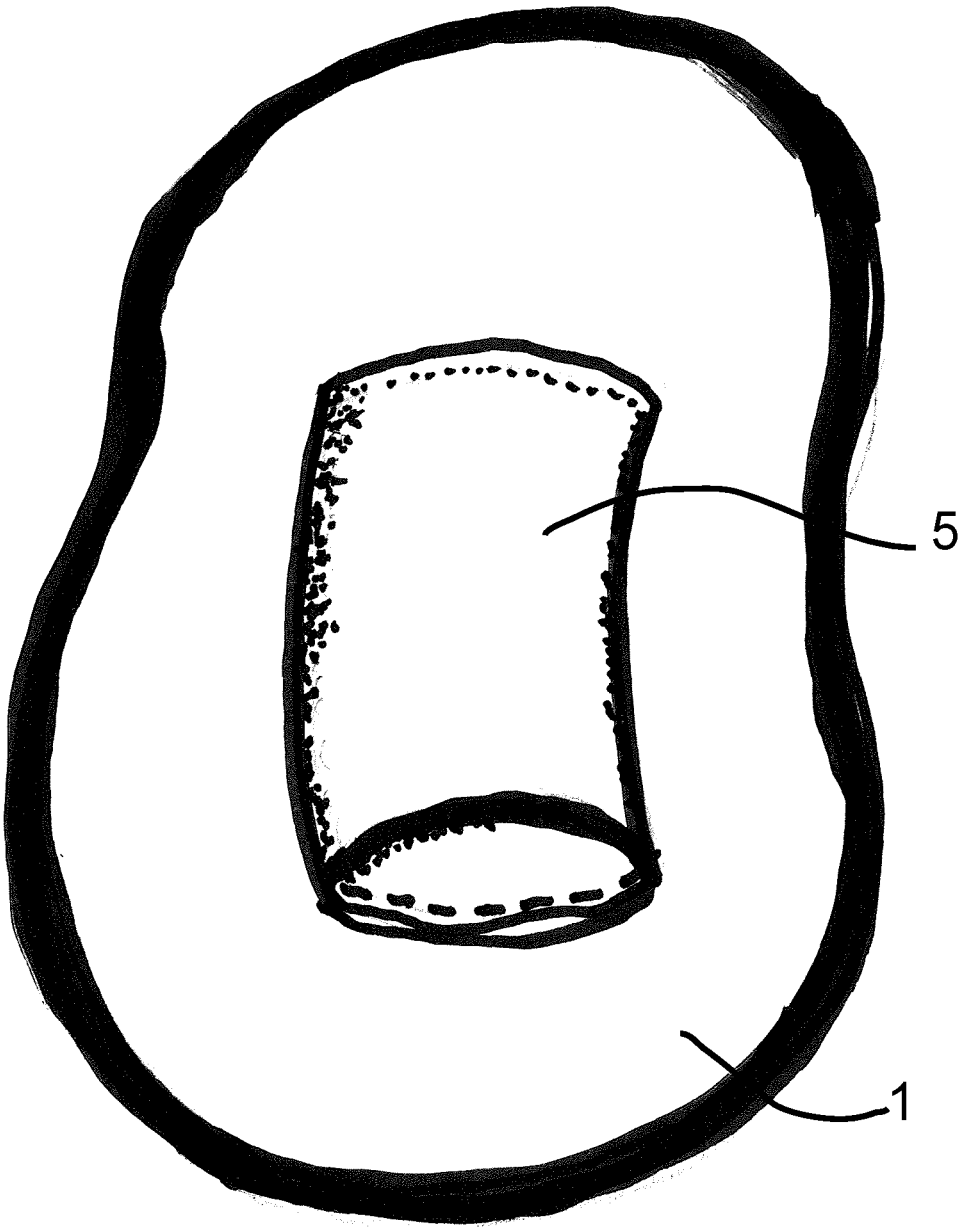
FIG. 9 is of one embodiment showing the backside of the infant holder showing a pass-through tube for a caregiver's hand or arm.

The backside can be comprised of either an elastic pass through tube 5, or a plurality of adjustable straps 6, as shown in FIGS. 3 and 4, or both. The arm and hand 7 is shown. The plurality of adjustable straps 6 can have releasable fasteners which can be, but are not limited to, hook and loop type, hook and pile type, touch type, snap connectors with adjustable straps going through them, straps and locking D type rings, belt type (roller, holes and pin), snaps at a plurality of distances, or any other releasable fastener known in the art and suitable for the purpose of holding straps together. The plurality of releasable straps 6 and pass through tube 5 can be secured to the base 1 by various methods, including, but not limited to, sewing, fusing, bonding, gluing, riveting, or any other means known in the art for fastening straps or elastic fabric to an object. The elastic pass through tube 5 and plurality of straps 6 can be secured to the device in and orientation such that the caregiver's arm runs longitudinal or latitudinal in relation to the orientation of the infant when secured in the device.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. An infant holder, comprising:

a base having first and second sides, the first and second sides being opposite one another;

a bolster positioned on the first side of the base forming a wall around an inner portion of the first side of the base thereby creating an oblong partial enclosure on the front side of the base in which an infant can be contained;

a releasable fastener on the first side of the base that is connected to the holder and extends along a width of the oblong enclosure for securing an infant to the first side of the base; and a pass through tube sized to receive a caregivers forearm on the second side of the base to allow the caregiver to hold the infant holder.

2. The infant holder of claim 1, wherein the bolster position is adjustable and thereby a size and a shape of the partial enclosure is variable by adjustment of the position of the bolsters.

3. The infant holder of claim 1, having a first end and second end directly opposing each other, the bolster at the first end having a first leg rest gap and a second leg rest gap.

4. The infant holder of claim 1, wherein the first side releasable fastener comprises a plurality of straps for securing an infant to the first side of the base.

5. The plurality of straps of claim 4, comprising a hook and loop fastener or a hook and pile fastener.

6. The plurality of straps of claim 4, comprising a snap fastener.

7. The plurality of straps of claim 4, comprising a d-ring type fastener.

8. The plurality of straps of claim 4, comprising a touch type fastener.

9. The bolster of claim 1, comprising a plurality of bolsters.

10. The bolster of claim 1, comprising washable fabric.

11. The bolster of claim 1, comprising memory foam.

12. The bolster of claim 1, comprising air bladders.

13. The bolster of claim 1, comprising gel-type bladders.

14. The bolster of claim 1, comprising soft, compliant padding materials.

15. The second side fastener of claim 1, wherein the pass through tube is made of a pliable, elastic material.

16. The second side fastener of claim 1, the pass through tube being made of a plurality of straps that are releasably connected to one another.

17. The plurality of straps of claim 16, comprising a hook and loop fastener or a hook and pile fastener.

18. The plurality of straps of claim 16, comprising a snap type fastener.

19. The infant holder of claim 1, wherein the pass through tube is located on the second side approximately opposite the oblong partial enclosure on the first side.

20. The infant holder of claim 1, wherein the pass through tube is approximately centered on the second side of the base.

* * * * *